US006086424A

United States Patent [19]

Chang

[11] Patent Number: 6,086,424

[45] Date of Patent: Jul. 11, 2000

[54] ELECTRICAL CONNECTOR WITH RECESSED BOTTOM

[75] Inventor: Yao-Hao Chang, Chung-Ho, Taiwan

[73] Assignee: Hon Hai Precsion Ind. Co., Ltd., Taipei Hsien, Taiwan

[21] Appl. No.: 09/119,260

[22] Filed: Jul. 20, 1998

[30] Foreign Application Priority Data

Jul. 26, 1997 [TW] Taiwan ..... 86212738

[51] Int. Cl.[7] ..... H01R 23/70

[52] U.S. Cl. ..... 439/630

[58] Field of Search ..... 439/630, 83, 876, 439/260

[56] References Cited

U.S. PATENT DOCUMENTS

| | | | |
|---|---|---|---|
| 4,113,342 | 9/1978 | Andreaggi | 439/630 |
| 4,682,829 | 7/1987 | Kunkle et al. | 439/83 |
| 5,145,384 | 9/1992 | Asakawa et al. | 439/78 |
| 5,199,884 | 4/1993 | Kaufman et al. | 439/74 |
| 5,667,408 | 9/1997 | Broschard, III et al. | 439/630 |
| 5,938,456 | 8/1999 | Kozel et al. | 439/83 |

*Primary Examiner*—Khiem Nguyen
*Assistant Examiner*—Michael C Zarroli

[57] ABSTRACT

A SIM card connector includes a rectangular housing defining a number of contact passageways on opposite edges thereof, and a number of contacts retained in corresponding contact passageways of the housing. The rectangular housing comprises two opposite longitudinal sides and two opposite lateral sides and defines a recessed portion in a bottom face thereof through the longitudinal sides and the lateral sides. The recessed portion can accommodate a variety of electronic components and hot air can flow into the recessed portion from the longitudinal sides and the lateral sides of the housing to melt slug solders thereby securely connecting the electronic components to a PCB when the connector is mounted to the PCB.

9 Claims, 3 Drawing Sheets

ELECTRICAL CONNECTOR WITH RECESSED BOTTOM

BACKGROUND OF THE INVENTION

1. Field of the Invention

The present invention relates to an electrical connector, and particularly to an electrical connector for connecting with a SIM (Subscriber Identity Module) card.

2. The Prior Art

Conventional electrical connectors for connecting electrical cards to main boards in computers to meet different requirements are disclosed in U.S. Pat. Nos. 3,192,498, 4,175,821, 4,306,761, 4,645,278, 4,984,994, 5,007,865, 5,013,255, 5,259,769, 5,277,601, European Patent Publication Nos. 0677814 and 0704820, PCT Patent Publication No. WO95/18421 and Taiwan Patent Application Nos. 85205015, 85205018 and 85205019. The Taiwan Patent Applications disclose connectors each having a housing with a recessed lower portion to form a space which can additionally accommodate electronic components on the printed circuit board (PCB) on which the connector is mounted.

However, due to the recession being exposed to only two opposite sides of the housing, when the PCB is subject to a reflow process to solder the electronic components to the PCB, hot air cannot thoroughly flow through the recession to completely melt slug solder onto terminals of the electrical components in the recession and contact the PCB. Thus, some electrical components in the recession may not have a secure mechanical and satisfactory electrical connection with the PCB.

Furthermore, as fitting portions of contacts of the connector used to interferentially engage with the housing of the connector do not have any compressibility, the mounting of the contacts into the housing of the connector requires a large insertion force while having an unsatisfactory engagement with the housing.

Hence, an improved electrical connector is needed to eliminate the above mentioned defects of current electrical connectors.

SUMMARY OF THE INVENTION

Accordingly, an objective of the present invention is to provide an electrical connector, particularly a SIM card connector, with a lower recession which is exposed to four sides of the connector, whereby hot air can thoroughly flow through the recession to completely melt slug solder on terminals of electrical components in the recession.

Another objective of the present invention is to provide an electrical connector, particularly a SIM card connector, having contacts with compressible fitting portions so that the contacts can be fixed to a housing of the connector by a small insertion force and obtain a good fixing effectiveness with the housing.

To fulfill the above mentioned objectives, according to one embodiment of the present invention, a SIM card connector includes a rectangular housing defining two sets of three contact passageways extending from two opposite sides of the housing toward a middle thereof, respectively. The housing further defines a lower recession exposed to all four sides of the housing. Six contacts are fixedly received in the corresponding contact passageways by interferentially engaging fitting portions of the contacts with the housing, wherein each fitting portion has a slit formed therein so that each fitting portion is compressed by the housing when it is inserted into the corresponding contact passageway.

DETAILED DESCRIPTION OF THE PREFERRED EMBODIMENT

Reference will now be made in detail to the preferred embodiment of the present invention.

Figure 4:
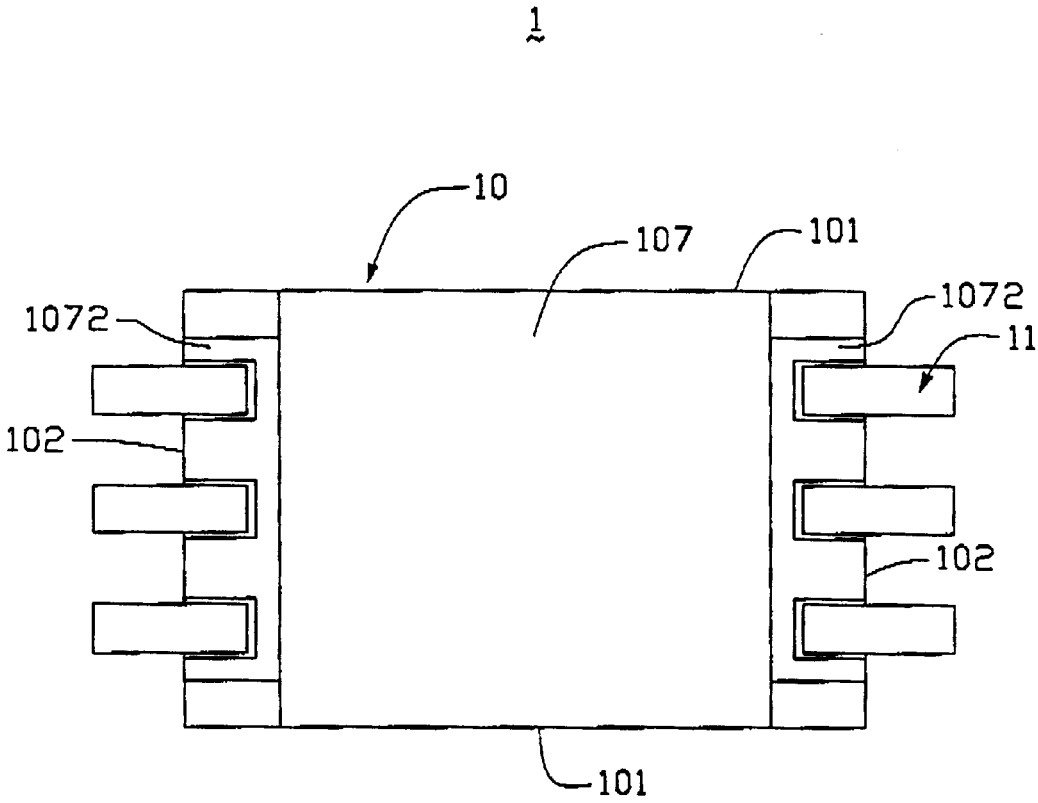
FIG. 4 is a bottom view of FIG. 2.

Referring to the drawings, a SIM card connector 1 in accordance with the present invention includes a rectangular housing 10 having a top face 108 for proximity to a SIM card (not shown), a bottom face 109 for proximity to a printed circuit board 30, two opposite longitudinal sides 101 and two opposite lateral sides 102 between the top and bottom faces 108, 109. Two sets of three contact passageways 103 are defined in the top face 108 and extend from the two lateral sides 102 toward a middle of the housing 10, respectively. Each contact passageway 103 defines an upper depression portion 104 which forms a stop 1042 thereabove, and a lower channel portion 105 having a flared inlet 106. The housing 10 further defines a lower recessed portion 107 through the longitudinal sides 101 of the housing 10 and exposed to the lateral sides 102 thereof via two opposite concave portions 1072 which are shallower than the lower recessed portion 107, as shown in FIG. 4.

Two sets of three contacts 11 each connected to a common blank portion 12 are mounted into the corresponding contact passageways 103. Each contact 11 has a fitting portion 110 with barbs 115 on two longitudinal sides thereof and a longitudinal slit 116 defined therein which provides each fitting portion 110 with a certain degree of compressibility. A tail portion 111 extends below and rearward from the fitting portion 110 to connect with the blank portion 12 via a corresponding dent 122 formed between the tail portion 111 and the blank portion 12. An arced bridging section 113 extends in front of the corresponding fitting portion 110 to connect with a corresponding contact portion 114 for engaging with the SIM card (not shown). The contact portion 114 is located above the fitting portion 110 and is terminated at an enlarged free end 117 thereof.

To assemble the connector 1, the two sets of contacts 11 are successively mounted into the contact passageways 103 by extending the fitting portions 110 into the corresponding channels 105 via the corresponding inlets 106 to reach a position in which the fitting portions 110 are located in the corresponding contact passageways 13 and compressed by the housing 10. The free ends 117 of the contact portions 114 are retained by the corresponding stops 1042 above the corresponding depression portions 104 to obtain a preload therein. The contact portions 114 project beyond the top face 108 of the housing 10. When the fitting portions 110 are inserted into the corresponding contact passageways 103, they are compressed by the housing 10 defining the contact passageways 103, thus, the force required to insert the contacts 11 into the housing 10 to the finally assembled position can be reduced. Furthermore, since the fitting portions 110 are fixed in position simultaneously by a compressing force of the housing 10 being exerted thereon and an interferential fit between the housing 10 and the barbs 115 thereof, the contacts 11 are securely fixed in the housing 10.

Figure 1:
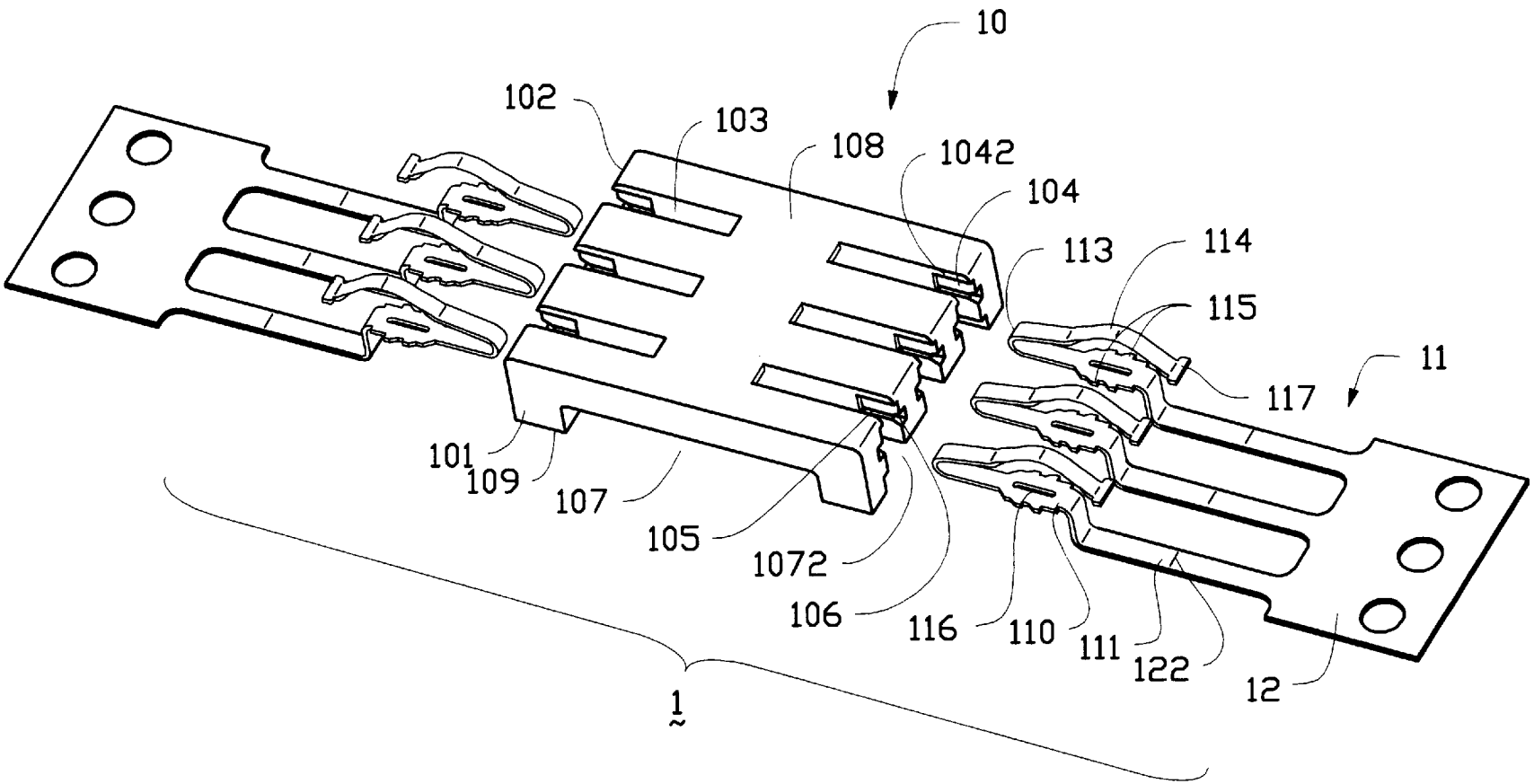
FIG. 1 is a perspective, exploded view of a SIM card connector in accordance with the present invention, wherein each set of three contacts are connected to a common blank portion.
Figure 2:
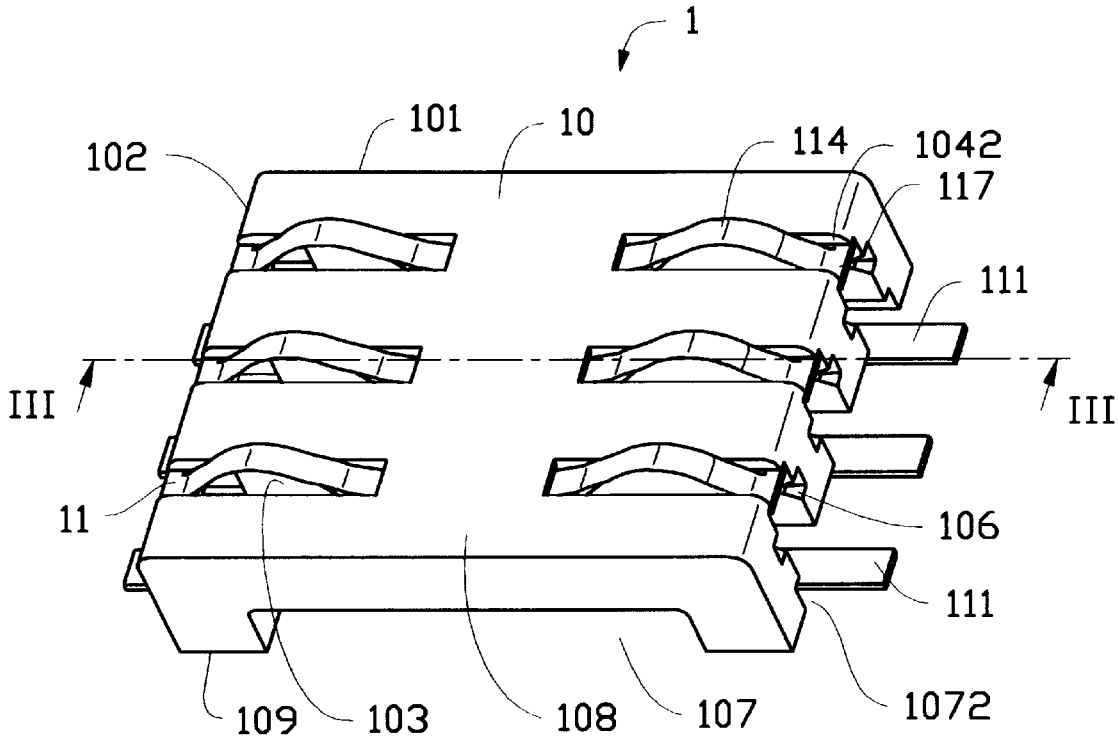
FIG. 2 is a perspective view of the assembled SIM card connector having the blank portions of the contacts removed.

After the contacts 11 are mounted to the housing 10, the blank portions 12 are removed from the tail portions 111 as shown in FIG. 2, by bending the blank portions 12 relative to the tail portions 111 along the dents 122.

Figure 3:
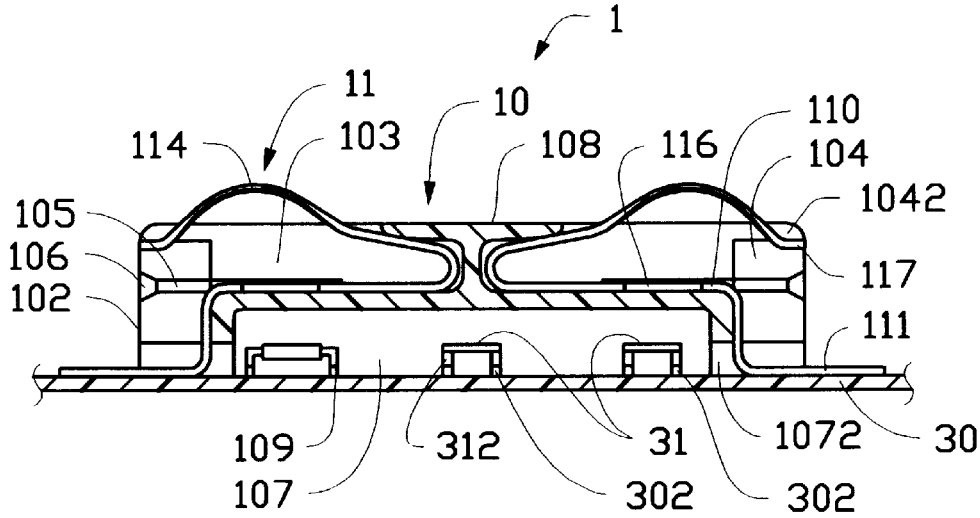
FIG. 3 is a cross-sectional view taken along line III—III of FIG. 2 wherein the SIM card connector is mounted to a printed circuit board for being soldered thereto.

When the connector 1 is mounted to the printed circuit board 30 as shown in FIG. 3, the recessed portion 107 can accommodate a variety of electronic components 31 therein. When the PCB 30 together with the connector 1 is subject to a reflow process to melt slug solder 302 on terminals 312 of the electronic components 31 in contact with the PCB 30, hot air can flow into the recessed portion 107 not only from the longitudinal sides 101 of the housing 10 but also from the lateral sides 102 of the housing 10 via the concave portions 1072. Thus, the hot air can thoroughly flow through the recessed portion 107 to melt the slug solder 302 thereby securely connecting the electronic components 31 to the PCB 30.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector, comprising:

a rectangular dielectric housing having a top face for proximity to an electrical card, a bottom face for proximity to a mother board, two longitudinal sides and two lateral sides between the top and bottom faces, a number of contact passageways extending from the two lateral sides toward a middle of the housing, and a lower recession in the bottom face having openings exposed to the longitudinal and lateral sides; and a number of contacts fixedly received in the corresponding contact passageways, each contact having a contact portion projecting upwardly beyond the top face of the housing.

2. The electrical connector in accordance with claim 1, wherein the recession is exposed to the lateral sides of the housing via two opposite concave portions defined in the bottom face which are shallower than the recession.

3. The electrical connector in accordance with claim 1, wherein each contact has a fitting portion compressed by and interferentially engaging with the housing, each fitting portion defining a slit therein.

4. The electrical connector in accordance with claim 1, wherein each contact passageway has a depression defining a stop thereabove, and the contact portion of each contact has a free end retained by the corresponding stop so that a preload exists in the contact portion.

5. The connector in accordance with claim 4, wherein each contact passageway defines a channel with a flared inlet below the corresponding depression for guiding an insertion of the corresponding fitting portion of the contact into the corresponding contact passageway to fixedly engage with the housing.

6. The connector in accordance with claim 3, wherein each contact has a tail portion for being soldered to a mother board, the tail portion extending below the corresponding fitting portion in a direction away from the middle of the housing.

7. The connector in accordance with claim 3, wherein the contact portion of each contact is located above the corresponding fitting portion.

8. The connector in accordance with claim 7, wherein each contact has an arced portion connecting the corresponding fitting portion to the contact portion.

9. An electrical connector for connecting an electrical device to a mother board on which the electrical connector is mounted, comprising:

a housing defining a number of contact passageways; and a number of contacts mounted into the corresponding contact passageways, each contact having a fitting portion defining a slit therein and compressed by and interferentially engaging with the housing, a contact portion extending from a first end of the fitting portion for connecting with the electrical device, and a tail portion extending from a second end of the fitting portion for being soldered to the mother board; wherein the housing has a top face from which the contact portions of the contacts project beyond, a bottom face opposite the top face and a perimeter between the top and bottom faces, the bottom face defining a recession exposed to the perimeter, and wherein the perimeter of the housing has a rectangular configuration with two longitudinal sides and two lateral sides, the recession exposed to the lateral sides via two opposite concave portions which are shallower than the recession.

* * * * *